US009577364B2

(12) United States Patent
Huo et al.

(10) Patent No.: US 9,577,364 B2
(45) Date of Patent: Feb. 21, 2017

(54) CABLE CONNECTOR COMPONENT, BOARD CONNECTOR COMPONENT, AND ELECTRIC CONNECTOR ASSEMBLY THEREOF

(71) Applicant: SHENZHEN DEREN ELECTRONIC CO., LTD., ShenZhen (CN)

(72) Inventors: Zhudong Huo, ShenZhen (CN); Junlan Peng, ShenZhen (CN); Zhengyi Chen, ShenZhen (CN); Weifeng Ren, ShenZhen (CN)

(73) Assignee: SHENZHEN DEREN ELECTRONIC CO., LTD., ShenZhen (CN)

( * ) Notice: Subject to any disclaimer, the term of this patent is extended or adjusted under 35 U.S.C. 154(b) by 0 days.

(21) Appl. No.: 14/772,085

(22) PCT Filed: Jun. 4, 2015

(86) PCT No.: PCT/CN2015/080742
§ 371 (c)(1),
(2) Date: Sep. 2, 2015

(87) PCT Pub. No.: WO2015/196913
PCT Pub. Date: Dec. 30, 2015

(65) Prior Publication Data

US 2016/0372858 A1 Dec. 22, 2016

(30) Foreign Application Priority Data

Jun. 27, 2014 (CN) ..... 2014 2 0353577 U
Apr. 10, 2015 (CN) ..... 2015 2 0215070 U

(51) Int. Cl.
*H01R 13/516* (2006.01)
*H01R 13/6581* (2011.01)
*H01R 13/6591* (2011.01)

(52) U.S. Cl.
CPC ..... *H01R 13/516* (2013.01); *H01R 13/6581* (2013.01); *H01R 13/6591* (2013.01)

(58) Field of Classification Search
USPC ..... 439/607.05, 607.45, 607.46, 607.55, 449
See application file for complete search history.

(56) References Cited

U.S. PATENT DOCUMENTS 4,601,527 A * 7/1986 Lemke ..... H01R 23/6873 439/607.08
4,824,383 A * 4/1989 Lemke ..... H01R 24/60 439/108

(Continued)

FOREIGN PATENT DOCUMENTS

CN 2711939 Y 7/2005
CN 201829739 U 5/2011

(Continued)

*Primary Examiner* — Alexander Gilman
(74) *Attorney, Agent, or Firm* — Na Xu; IPro, PLLC

(57) ABSTRACT

The invention provides a cable connector component, a board connector component, and an electric connector assembly thereof. The cable connector component includes a connector, a fixed iron shell, and a cable including a plurality of core wires. The connector includes at least one pair of terminal pair, a first insulating body, a first metal shell, a group strip, and a printed circuit board. The terminal pair, the ground strip, and the first metal shell are assembled with the first insulating body. The first metal shell is assembled with the fixed iron shell. The fixed iron shell includes a convex hull which facilitates the cable to insert into the fixed iron shell. The board connector component, includes: a second metal shell including a butting chamber, a terminal group and a second insulting body which are fixed in the second metal shell. The second insulting body includes a base and a clapper disposed at a front end of the base. The clapper includes a first surface and a second surface which are disposed oppositely. A shielding plate is (Continued)

disposed between the first surface and the second surface, and the shielding plate includes a protrusion which is extended out of a side of the base and abuts against the second metal shell. As a result, a new grounding path is formed, which can reduce the electromagnetic interference and strengthen the insulating effect.

20 Claims, 14 Drawing Sheets

(56) References Cited

U.S. PATENT DOCUMENTS 5,114,364 A 5/1992 Hunter
5,219,294 A * 6/1993 Marsh ..... H01R 23/6873 439/607.28
5,567,168 A * 10/1996 Marsh ..... H01R 13/6485 439/181
5,785,557 A * 7/1998 Davis ..... H01R 13/26 439/108
6,450,837 B1 * 9/2002 Givens ..... H01R 13/65802 439/607.28
6,872,085 B1 * 3/2005 Cohen ..... H01R 23/688 439/108
6,954,363 B2 * 10/2005 Fan ..... H01R 13/631 361/752
7,758,374 B2 * 7/2010 Yu ..... H01R 4/027 439/493
7,758,379 B2 * 7/2010 Chen ..... H01R 13/6485 439/607.11
7,922,536 B2 * 4/2011 Zhang ..... H01R 13/6583 439/607.45
7,976,342 B2 * 7/2011 Farole ..... H01R 13/6581 439/607.57
8,403,706 B2 * 3/2013 Wu ..... H01R 13/506 439/607.46
8,503,191 B2 * 8/2013 Nagata ..... H01R 13/6658 361/799
8,562,378 B2 * 10/2013 Su ..... H01R 13/502 439/607.55
8,840,321 B2 * 9/2014 Wu ..... G02B 6/3817 385/89
8,870,606 B2 * 10/2014 Yu ..... H01R 9/031 439/701
9,004,945 B2 * 4/2015 Nagata ..... H01R 13/6594 439/607.35
9,325,125 B2 * 4/2016 Fang ..... H01R 13/6471
9,397,435 B2 * 7/2016 Xing ..... H01R 13/504
9,431,781 B2 * 8/2016 Kuang ..... H01R 24/60
9,461,378 B1 * 10/2016 Chen ..... H01R 12/51
2014/0024257 A1 * 1/2014 Castillo ..... H01R 13/6585 439/607.05

FOREIGN PATENT DOCUMENTS

CN 103579861 A 2/2014
CN 204011986 U 10/2014
CN 104767067 A 7/2015

* cited by examiner

CABLE CONNECTOR COMPONENT, BOARD CONNECTOR COMPONENT, AND ELECTRIC CONNECTOR ASSEMBLY THEREOF

This application is a national stage application of PCT application PCT/CN2015/080742 filed on Jun. 4, 2015, which claims priority to Chinese Patent Applications No. 201420353577.6 filed on Jun. 27, 2014 and 201520215070.9 filed on Apr. 10, 2015, three of which are hereby incorporated by reference in their entireties.

BACKGROUND OF THE INVENTION

The invention relates to the field of connector, and more particularly to a cable connector component, a board connector component, and an electric connector assembly thereof.

FIELD OF THE INVENTION

In use, conventional electric connectors tend to misplug thereby causing huge damage. With the development of technology, the electronic products are increasingly multi-functional and ultrathin, while the corresponding electric connectors have large dimensions or single function, which cannot meet the demand. In recent years, connectors with high-speed transmission and decreased dimensions have been created, which can meet the requirements of electronic products.

However, the high speed connectors include a plurality of terminal pairs, and limited by the dimension of the connectors, the quality of the terminals is highly required, so it is difficult for the terminals to transmit high-speed and stable signals. In addition, the cable of the cable connector component includes a plurality of core wires, and thus how to connect the core wire and the terminals and maintain an appropriate external dimension of the component is another tough problem.

Furthermore, the shielding plate of the board connector abutting against the high-speed cable connector is grounded by connecting to PCB in the manner of SMT (Surface Mount Technology). However, the grounding is not reliable, thereby adversely affecting the connection reliability of the cable connector and the board connector, as well as the transmission stability of high speed signals.

SUMMARY OF THE INVENTION

In view of the above-described problems, it is one objective of the invention to provide cable connector component, board connector component, and electric connector assembly thereof. The cable connector component features reduced dimensions, the board connector component features enhanced insulating effect, and thus, the connection reliability is greatly improved, and the transmission stability of the high speed signal is ensured.

To achieve the above objective, in accordance with one embodiment of the invention, there is provided a cable connector component, comprising a connector, a fixed iron shell, and a cable comprising a plurality of core wires, wherein the connector comprises at least one pair of terminal pair, a first insulating body, a first metal shell, a group strip, and a printed circuit board; the terminal pair, the ground strip, and the first metal shell are assembled with the first insulating body; the first metal shell is assembled with the fixed iron shell; the fixed iron shell comprises a convex hull which facilitates the cable to insert into the fixed iron shell; the core wires of the cable pass through the fixed iron shell and are connected to one portion of the printed circuit board; a soldering end of the terminal pair is soldered on the other portion of the printed circuit board; and the printed circuit board comprises a wiring communicating with the core wires and the terminal pair.

In a class of this embodiment, the fixed iron shell comprises a sleeve and a cylinder which is formed by the extension of the sleeve; the convex hull is disposed on an upper and/or a lower surface of the sleeve in the vicinity of the cylinder; the convex hull communicates with the cylinder and protrudes upwards with an appropriate height whereby facilitating the cable to insert into the sleeve.

In a class of this embodiment, the fixed iron shell is provided with a welding point, and the welding point is welded and fixed on the first metal shell.

In a class of this embodiment, the welding point is disposed on a front end of the upper/lower surface of the sleeve; the sleeve is concave towards the first metal shell to form the welding point; the first metal shell comprises a front end and a rear end; the sleeve covers the rear end and is welded and fixed with the rear end.

In a class of this embodiment, the terminal pair comprises a first terminal and a second terminal; the first terminal comprises a first contact part, a first connection part, and a first soldering part; the second terminal comprises a second contact part, a second connection part, and a second soldering part; the first connection part and the second connection part comprise a first locking point and a second locking point, respectively, which are disposed oppositely and staggered with each other, and further comprise a first recess and a second recess which are staggered with each other.

In a class of this embodiment, two first locking points and two second locking points are provided, and the first recess is disposed between the two first locking points, the second recess is disposed between the two second locking points; the first recess is concave in the first terminal away from the second terminal; the second recess is concave in the second terminal away from the first terminal.

In a class of this embodiment, the first locking point in the vicinity of the first contact part and the second locking point in the vicinity of the second contact part are completely staggered, and a projection of the second locking point in the vicinity of the second contact part is overlapped with a projection of the first recess.

In a class of this embodiment, the first recess is increasingly narrow from one of the first locking points in the vicinity of the first contact part to the other first locking point; and the second recess is increasingly narrow from one of the second locking points in the vicinity of the second contact part to the other second locking point.

In a class of this embodiment, the cable comprises a shielding layer coating the core wires, and the shielding layer contacts the fixed iron shell.

In a class of this embodiment, the assembly further comprises a fixed block, and the fixed block covers a soldering zone of the printed circuit board.

In invention further provides a board connector assembly, comprising: a second metal shell comprising a butting chamber, a terminal group and a second insulting body which are fixed in the second metal shell, the second insulting body comprising a base and a clapper disposed at a front end of the base, the clapper comprising a first surface and a second surface which are disposed oppositely, wherein a shielding plate is disposed between the first surface and the second surface, and the shielding plate comprises a protrusion which is extended out of a side of the base and abuts against the second metal shell.

In a class of this embodiment, a position of the second metal shell corresponding to the protrusion is punched towards the abutting chamber to form a contact part abutting against the protrusion.

In a class of this embodiment, a soldering part extending downwards is disposed at a rear end of the shielding plate.

In a class of this embodiment, the terminal group comprises a third terminal and a fourth terminal, and the second insulating body comprises a first module fixing the third terminal and a second module fixing the fourth terminal.

In a class of this embodiment, the shielding plate is fixed on the second module in the manner of mounting.

In a class of this embodiment, a rear end of the shielding plate bends downwards to form a reinforcement part corresponding to a high frequency signal terminal.

In a class of this embodiment, the first module is provided with a first ground strip, the second module is provide with a second ground strip, and the first ground strip and the second ground strip are fixed on sides of the first module and the second module, respectively, by laser welding.

In a class of this embodiment, an upper cover is provided on the second metal shell to limit and fix the second metal shell.

In another aspect, the invention also provides a composite electric connection, comprising the cable connector component and the board connector component mentioned above.

Advantages according to embodiments of the invention are summarized as follows. The arrangement of the convex hull enlarges the inner chamber of the fixed iron shell, thus facilitating the cable to pass through the fixed iron shell. Thereafter, the convex hull is pressed down, which reduces the dimension of the cable connector component and enables the cable connector component more compact and reliable, and ensures the connection reliability of the cable connector component and the transmission stability of high speed signals. Meanwhile, the shielding plate of the board connector component comprises the protrusions extended out of two sides of the shielding plate and abutting against the second metal shell. As a result, a new grounding path is formed, which can further reduce the electromagnetic interference and strengthen the insulating effect, and enable the cable connector component more compact and reliable, ensures the connection reliability of the cable connector component and the transmission stability of high speed signals.

DETAILED DESCRIPTION OF THE EMBODIMENTS

Figure 1:
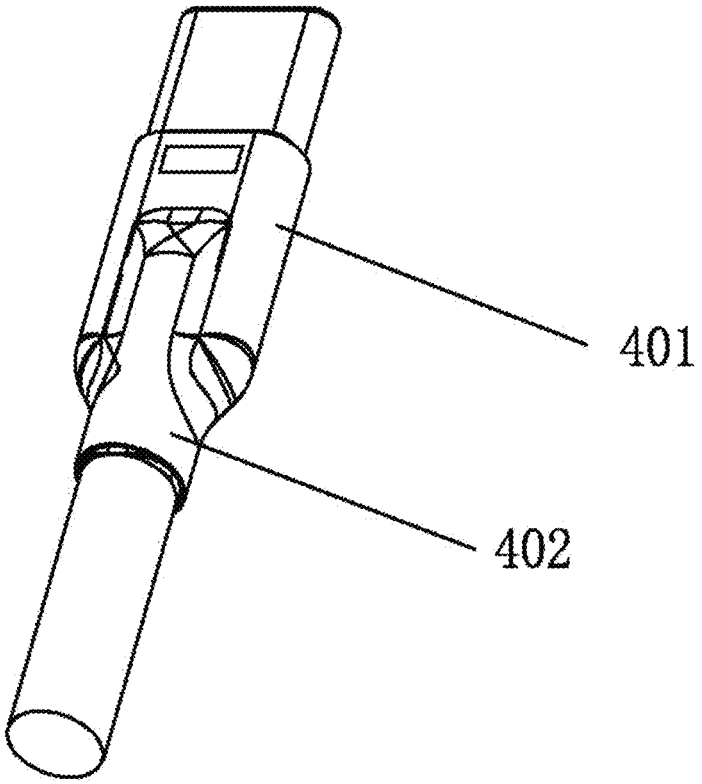
FIG. 1 is a stereogram of a cable connector component of the invention which is not pressed.
Figure 2:
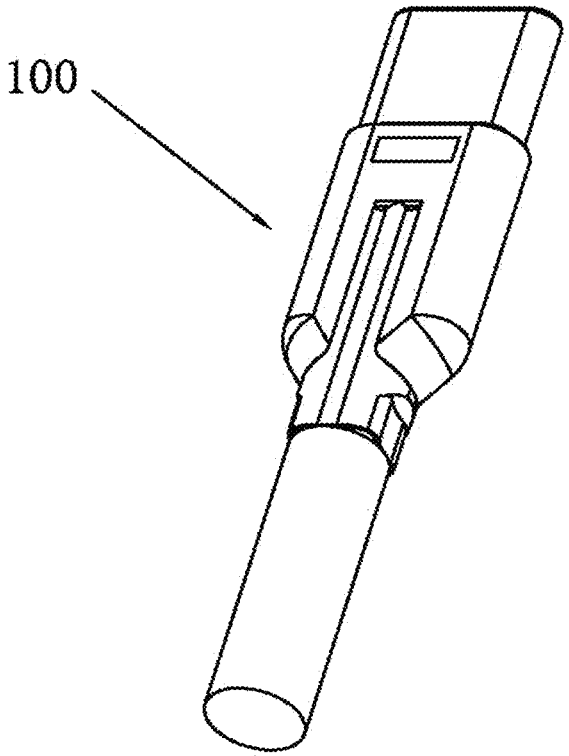
FIG. 2 is a stereogram of a cable connector component of the invention which has been pressed.
Figure 3:
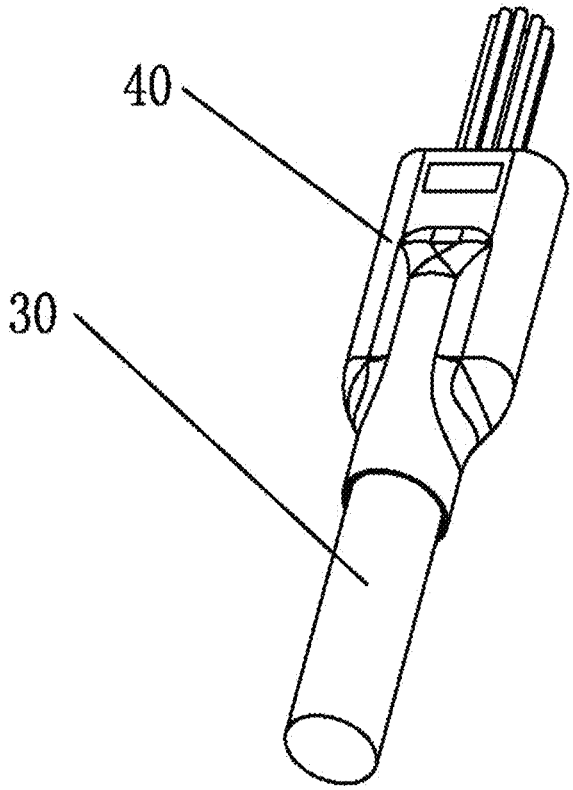
FIG. 3 is a first stereogram of a cable connector component of the invention.
Figure 4:
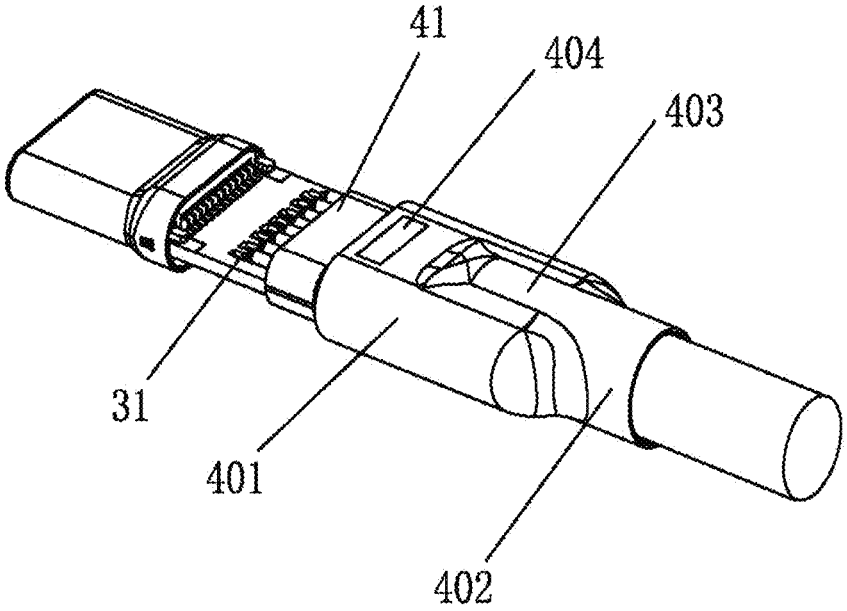
FIG. 4 is a second stereogram of a cable connector component of the invention.
Figure 5:
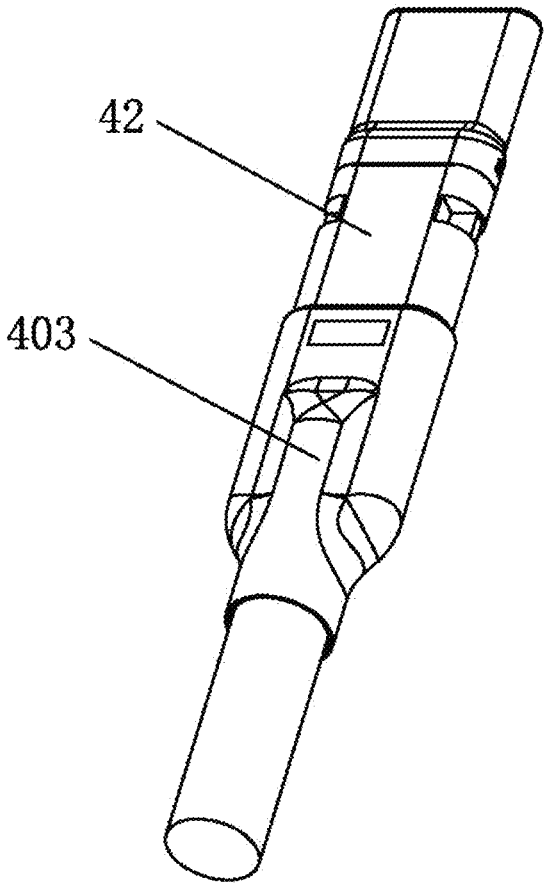
FIG. 5 is a third stereogram of a cable connector component of the invention.
Figure 6:
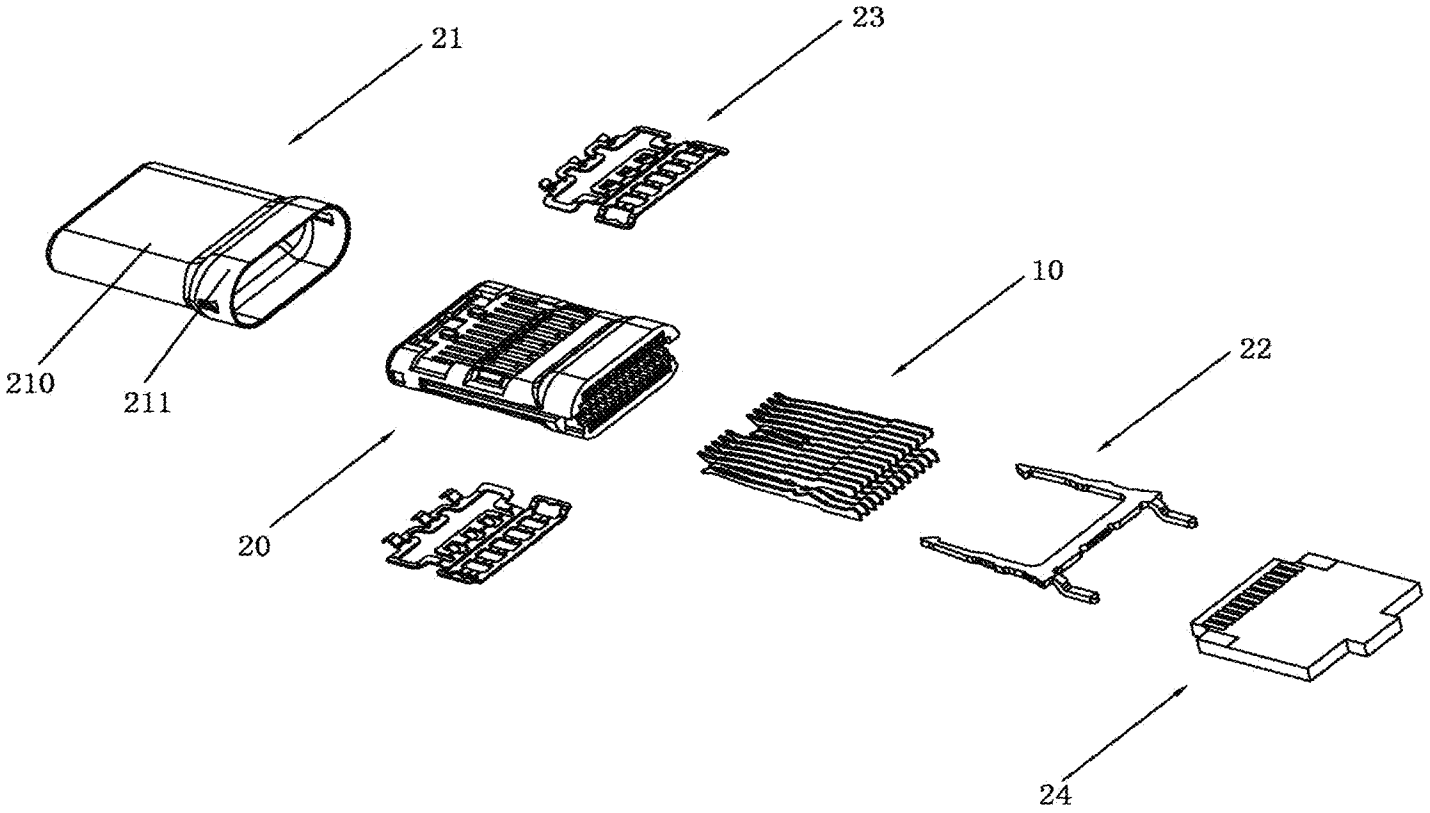
FIG. 6 is an exploded view of a cable connector component of the invention.
Figure 7:
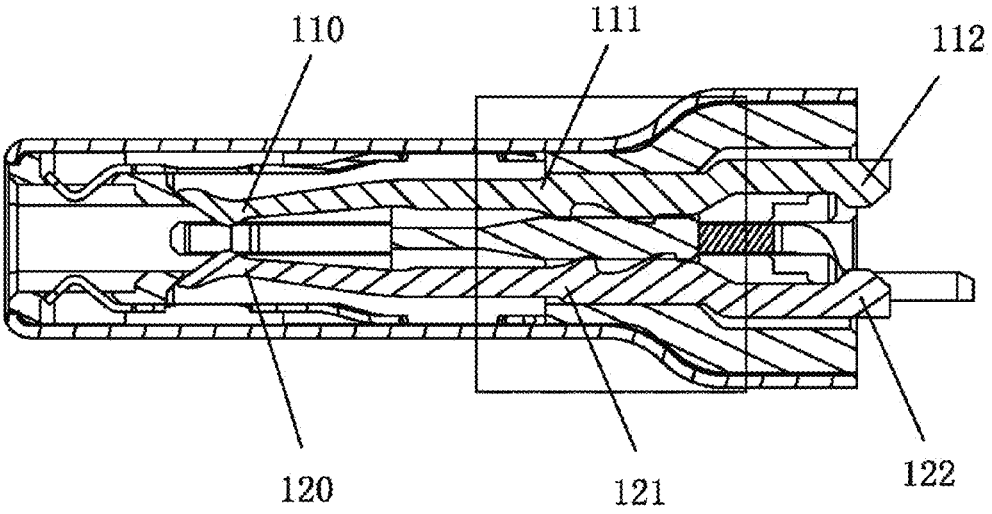
FIG. 7 is a sectional view of a cable connector component of the invention.

For further illustrating the invention, experiments detailing a cable connector component, a board connector component, and an electric connector assembly thereof are described below. It should be noted that, when an element is described as "being connected to" or "being fixed to" another, the two elements are directly connected/fixed or the two elements are indirectly connected/fixed with one or more intermediate elements included there between. The terms "vertical", "horizontal", "left", and "right" and the like are intended to describe and not to limit the invention.

Unless otherwise defined, all of the technical and scientific terms used in this specification are commonly understood by those skilled in the art. In this specification, the terms are used only for the purpose of describing particular embodiments, and not intended to limit the invention. The term "and/or" as used in this specification includes any one or more of the associated listed items and all combinations thereof.

As shown in FIGS. 1-7, a cable connector component 100 comprises a connector, a fixed iron shell 40, and a cable 30 comprising a plurality of core wires, a cable clamp 41 and a fixed block 42. The connector comprises at least one pair of terminal pair 10, a first insulating body 20, a first metal shell 21, a group strip 22, shielding sheets 23, and a printed circuit board 24. In this example, a plurality of terminal pairs 10 are provided and are fixed on the first insulating body 20. The shielding sheets 23 are fixed on the upper and lower surfaces of the first insulating body 20, respectively. The shielding sheets 23 are fixed on the first insulating body 20 and are located between two terminals of the terminal pair 10, thereby achieving better insulating effect. The first metal shell 21 covers the first insulating body 20, and comprises a front end 210 and a rear end 211 corresponding to the first insulating body 20. The front end 210 and the rear end are not in the same plane. The cable connector component is assembled according to conventional technology.

The soldering end of the terminal pair 10 is exposed out of the first insulating body 20 and is soldered on one portion of the printed circuit board 24. The cable 30 comprises a plurality of core wires 31, which are soldered on the other portion of the printed circuit board 24. The printed circuit board comprises a wiring (not shown in figures), through which the core wires and the soldering end of the terminal pair are electrically connected. For better fixing the cable and achieving better insulating effect, the cable is sleeved with the fixed iron shell 40. The fixed iron shell 40 comprises a sleeve 401 and a cylinder 402 which is formed by the extension of the sleeve; a convex hull 403 is disposed on an upper and/or a lower surface of the sleeve 401 in the vicinity of the cylinder. The convex hull 403 protrudes upwards with an appropriate height, whereby facilitating the cable 30 to insert into the sleeve 401. The convex hull 403 communicates with the cylinder 402.

Upon assembling the cable connector component, the outer insulating layer at the front end of the cable 30 is peeled off, and thus the single core wire and the shielding layer are exposed. The shielding layer covers the core wire. In general, the fixed iron shell 40 has a fixed size. In case the size of the cable is slightly large, the cable fails to enter the fixed iron shell 40, and the core wires 31 cannot pass through the fixed iron shell 40. The arrangement of the convex hull 403 enlarges the inner chamber of the fixed iron shell, and facilitates the cable to pass through the fixed iron shell 40. After the core wires are welded on the printed circuit board 24, the convex hull 403 is pressed downward. Actually, the height and size of the convex hull 403 are determined by the actual dimensions and manufacturing process of the cable 30. The convex hull 403 can also be disposed at other position of the fixed iron shell as needed. With the pressing down of the convex hull 403, the rear end (not shown in the figures) of the fixed iron shell 40 which covers the cable is tightly pressed from up, down, left and right directions. The cable 30 is provided with a shielding braid, which is capable of contacting the downward pressed convex hull 403, thereby providing the cable connector assembly with better insulating effect. The cable connector assembly is further provided with an insulating coating (not shown in the figures).

The fixed iron shell 40 is provided with a welding point 404, and the welding point 404 is welded and fixed on the first metal shell 21. In this example, the welding point 404 is disposed on the upper/lower surface of the sleeve 401; the sleeve 401 is concave towards the first metal shell to form the welding point. Specifically, the welding point 404 is disposed at the front end of the sleeve 401. Upon assembly, the fixed iron shell 40 and the first metal shell are welded. Optionally, the welding point 404 can also be disposed on other plane of the sleeve 401 such as sides. Still optionally, other locking structures instead of the welding point such as locking points and/or locking hooks can be designed to fix together and make contact of the fixed iron shell 40 and the first metal shell 21.

The invention also provides a method for assembling the cable connector component 100. Firstly, the terminal pair 10, the first insulating body 20, the first metal shell 21, the ground strip 22, the shielding sheets 23, and the printed circuit board 24 are assembled to form a connector. The soldering part of the terminal pair 10 is soldered on one portion of the printed circuit board 24. Thereafter, the cable 30 is peeled off, and thus part of core wires 31 and the shielding layer are exposed. Insert the cable into the fixed iron shell 40, allow the core wires 31 to pass through the fixed iron shell 40, and fix the core wires 31 using a wire clamp 41, which can prevent the core wires 31 from scattering. The wire clamp 41 is a typical structure in the cable connector component of the prior art, no need to describe in detail. The core wires 31 are soldered on the other portion of the printed circuit board 24. The core wires 31 and the terminal pair 10 communicate with one another via the wiring of the printed circuit board 24. Plastic cement is mounted to form a fixed block, and the fixed block covers the printed circuit board 24. All the soldering points are covered by the fixed block. Finally, push the fixed iron shell 40 towards the front end of the first metal shell 21 so that the sleeve 401 covers the rear end of the first metal shell 21. The welding point 404 of the sleeve and the rear end of the first metal shell 21 are welded, whereby pressing down the convex hull 403 of the fixed iron shell 40. As a result, the sleeve 401 tightly presses the cable 30, and the rear end of the fixed iron shell 40 contacts the shielding layer of the cable 30.

It should be noted that, the fixed block 42 in the cable connector component cannot be disposed, or the plastic cement can be replaced by glue. When the core wires 31 need no fixing, the wire clamp 41 can also be absent.

In this example, the arrangement of the convex hull enlarges the inner chamber of the fixed iron shell, thus facilitating the cable to pass through the fixed iron shell. Thereafter, the convex hull is pressed down, which reduces the dimension of the cable connector component and enables the cable connector component more compact and reliable, and ensures the connection reliability of the cable connector component and the transmission stability of high speed signals.

Figure 8:
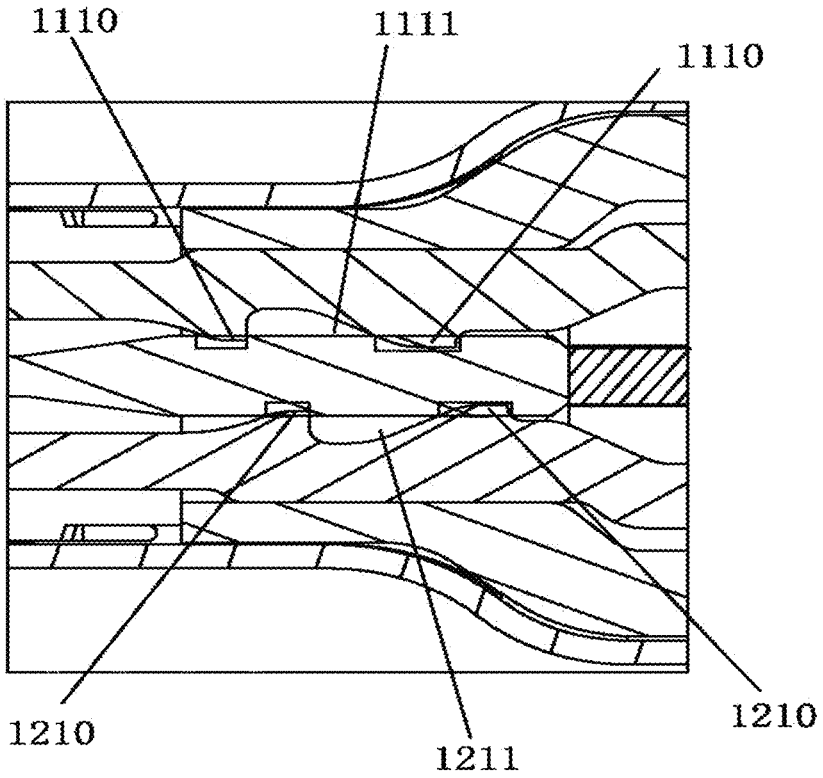
FIG. 8 is a local enlarged view of a cable connector component in FIG. 7.
Figure 9:
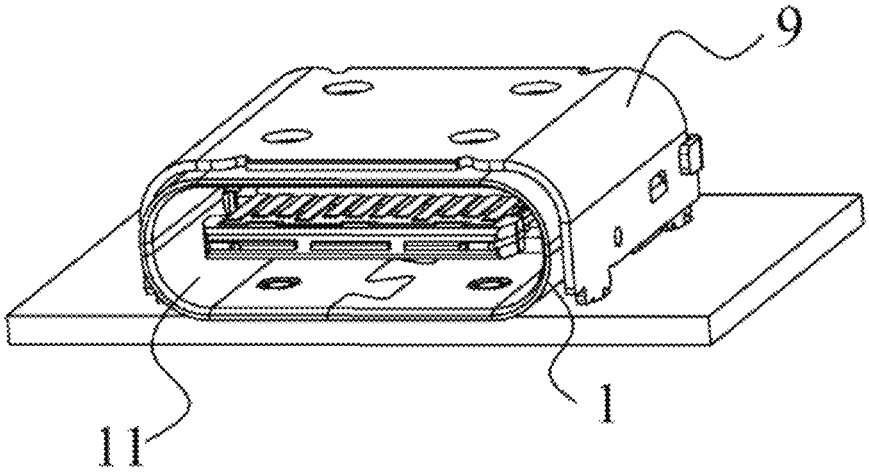
FIG. 9 is a schematic diagram of a board connector component of the invention.
Figure 10:
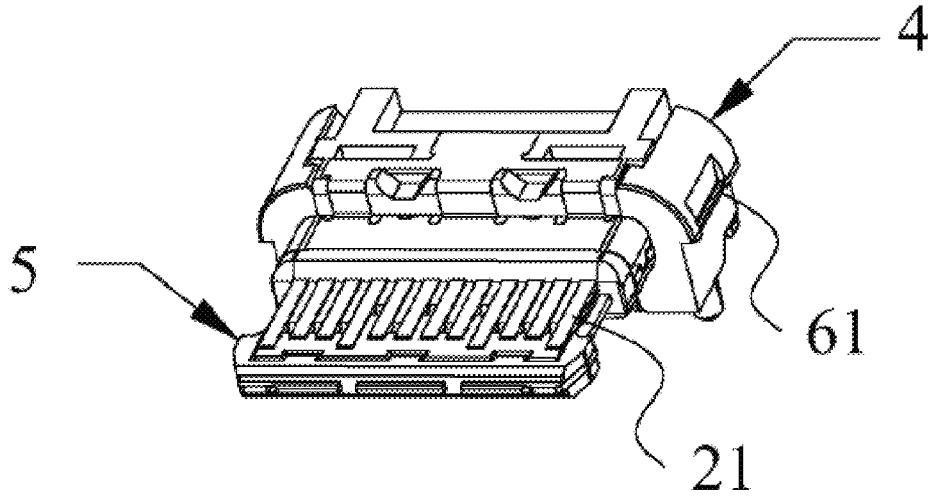
FIG. 10 is a schematic diagram showing the matching of a first module and a second module of a board connector component of the invention.
Figure 11:
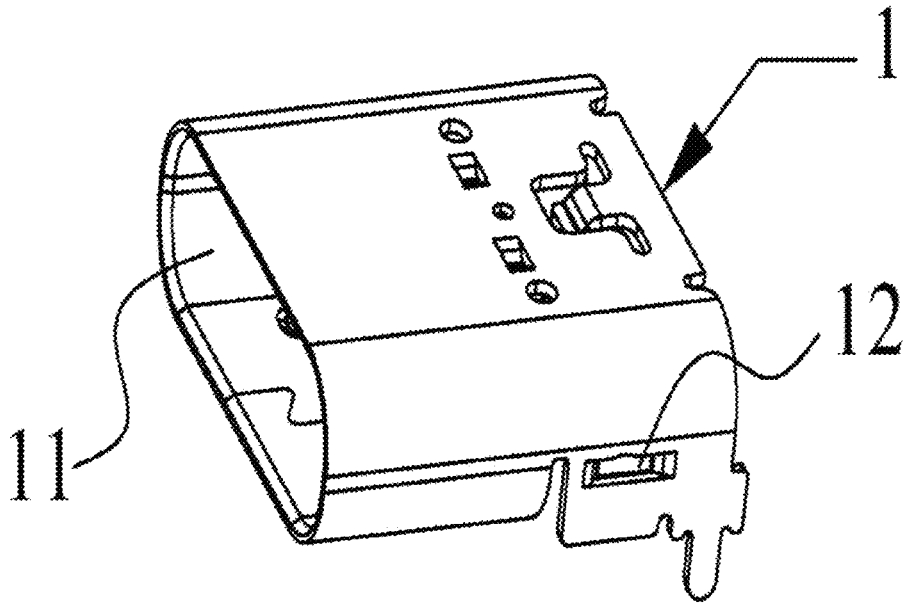
FIG. 11 is a schematic diagram of a second metal shell of a board connector component of the invention.
Figure 12:
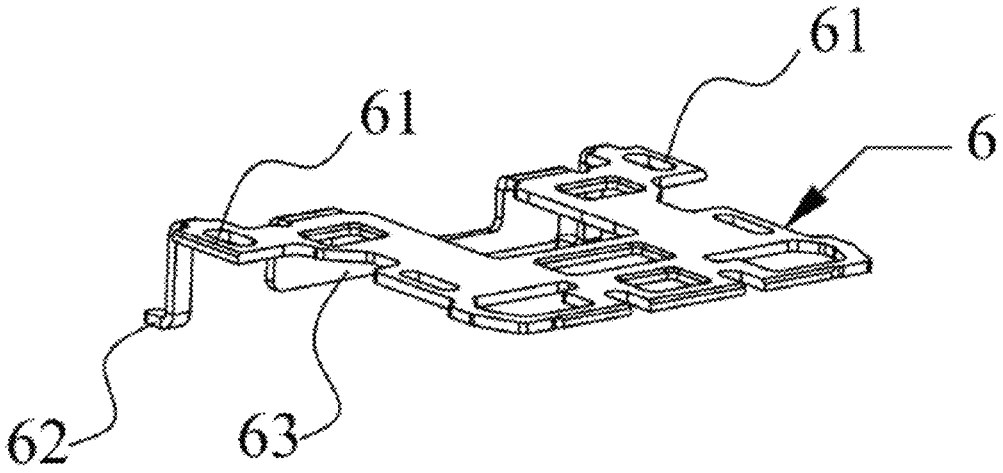
FIG. 12 is a schematic diagram of a shielding plate of a board connector component of the invention.
Figure 13:
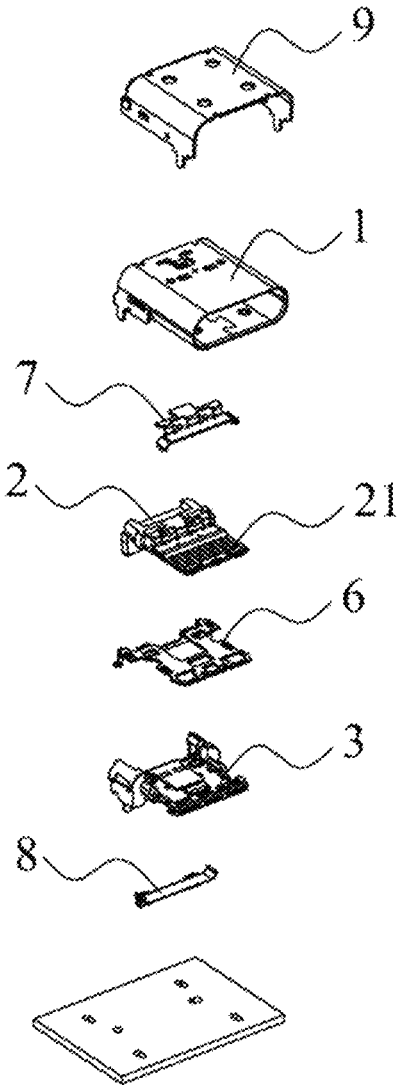
FIG. 13 is an exploded view of a board connector component of the invention.

As shown in FIGS. 8 and 9, the terminal pair 10 comprises a first terminal and a second terminal. In this example, the terminal pair is a pair of differential signal terminals. The first terminal and the second terminal align from top down. The first terminal comprises a first contact part 110, a first connection part 111, and a first soldering part 112; the second terminal comprises a second contact part 120, a second connection part 121, and a second soldering part 122; the first connection part 110 and the second connection part 120 comprise a first locking point 1110 and a second locking point 1210, respectively, which are disposed oppositely and staggered with each other. A first recess 1111 is disposed at one side of the first locking point 1110. A second recess 1211 is disposed at one side of the second locking point 1210. The first locking point 1110 and the second locking point 1210 can clamp a structure. Two first locking points 1110 and two second locking points 1210 are provided, and the first recess 1111 is disposed between the two first locking points 1110, the second recess 1211 is disposed between the two second locking points 1210; the first recess 1111 is concave in the first terminal away from the second terminal; the second recess 1211 is concave in the second terminal away from the first terminal. The first recess 1111 and the second recess 1211 are staggered mutually. Specifically, the first recess 1111 is increasingly narrow from one of the first locking points 1110 in the vicinity of the first contact part 110 to the other first locking point; and the second recess 1211 is increasingly narrow from one of the second locking points 1210 in the vicinity of the second contact part to the other second locking point. The second locking point 1210 in the vicinity of the second contact part is opposite to the first recess 1111. The arrangement of the locking points and the recesses improves the impedance encountering the terminal pair in the transmission of the high speed signals and the connection stability of the terminals, thereby facilitating the terminal pair to transmit stable high speed signals. It should be noted that, the stagger disposition mentioned in the invention includes complete staggering and partial staggering. As shown in FIG. 9, the first locking point in the vicinity of the first contact part and the second locking point in the vicinity of the second contact part are completely staggered, while the first locking point in the vicinity of the first soldering part and the second locking point in the vicinity of the second soldering part are partially staggered. The first recess and the second recess are also partially staggered. Whether complete staggering or partial staggering is decided by the actual situations. In this example, the projection of the second locking point in the vicinity of the second contact part is overlapped with the projection of the first recess.

As shown in FIGS. 10-15, a board connector component is provided to abut the cable connector component 100. The board connector component comprises: a second metal shell 1 comprising a butting chamber 11, an upper cover 9 disposed on the second metal shell to limit and fix the second metal shell, a terminal group and a second insulting body which are fixed in the second metal shell. The second insulting body comprises a base 4 and a clapper 5 disposed at a front end of the base. The clapper comprises a first surface and a second surface which are disposed oppositely. A shielding plate 6 is disposed between the first surface and the second surface, and the shielding plate comprises a protrusion 61 which is extended out of a side of the base 4 and abuts against the second metal shell 1. Preferably, a position of the second metal shell 1 corresponding to the protrusion 61 is punched towards the abutting chamber 11 to form a contact part 12 abutting against the protrusion. The contact part 12 contacts the protrusion 61 whereby forming a new grounding path, which strengthens the insulating effect. A soldering part 62 extending downwards is disposed at a rear end of the shielding plate 6.

The terminal group comprises a third terminal and a fourth terminal. The third terminal is disposed on the upper end surface of the clapper 5, and the fourth terminal is disposed on the lower end surface of the clapper 5, which favors the power or data exchange when connecting to a corresponding cable connector component 100. The second insulating body comprises a first module 2 fixing the third terminal 21 and a second module 3 fixing the fourth terminal. The first module 2 and the second module 3 are fixed by overlapping.

Figure 14:
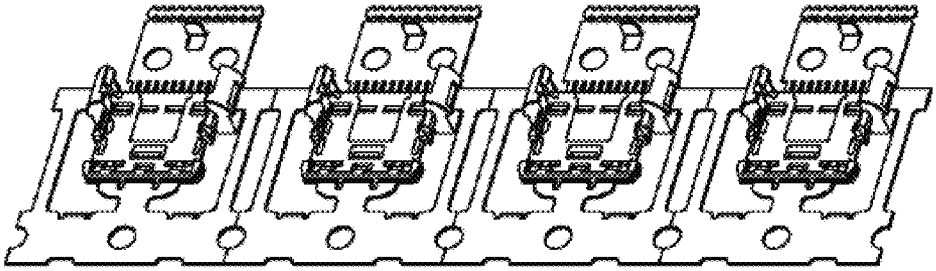
FIG. 14 is a schematic diagram of a board connector component of the invention comprising a plurality of one-step formed second modules.

Specifically, the shielding plate 6 is fixed on the second module 3 in the manner of mounting, i.e., the fourth terminal, the shielding plate 6 and plastic cement are mounted to form the second module 3. In practice, the material bands of the fourth terminal and the shielding plate 6 are one-step mounted to form a plurality of second modules 3, as shown in FIG. 14.

The rear end of the shielding plate 6 bends downwards to form a reinforcement part 63 corresponding to a high frequency signal terminal. The arrangement of the reinforcement part 63 further improves the insulating effect.

The first module 2 is provided with a first ground strip 7, the second module 3 is provide with a second ground strip 8, and the first ground strip 7 and the second ground strip 8 are fixed on sides of the first module 2 and the second module 3, respectively, by laser welding.

The shielding plate comprises the protrusions extended out of two sides of the shielding plate and abutting against the second metal shell. As a result, a new grounding path is formed, which can further reduce the electromagnetic interference and strengthen the insulating effect, and enable the cable connector component more compact and reliable, ensures the connection reliability of the cable connector component and the transmission stability of high speed signals.

The invention further comprises a composite electric connection comprising a cable connector component and a board connector assembly. The cable connector component and the board connector assembly can be combined in accordance with conventional connection modes.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A cable connector component, comprising a connector, a fixed iron shell, and a cable comprising a plurality of core wires, wherein the connector comprises at least one pair of terminal pair, a first insulating body, a first metal shell, a group strip, and a printed circuit board; the terminal pair, the ground strip, and the first metal shell are assembled with the first insulating body; the first metal shell is assembled with the fixed iron shell; the fixed iron shell is provided with a welding point, and the welding point is welded and fixed on the first metal shell; the core wires of the cable pass through the fixed iron shell and are connected to one portion of the printed circuit board; a soldering end of the terminal pair is soldered on the other portion of the printed circuit board; and the printed circuit board comprises a wiring communicating with the core wires and the terminal pair.

2. The cable connector component of claim 1, wherein the fixed iron shell comprises a sleeve and a cylinder which is formed by the extension of the sleeve; the fixed iron shell comprises a convex hull, the convex hull is disposed on an upper and/or a lower surface of the sleeve in the vicinity of the cylinder; the convex hull communicates with the cylinder and protrudes upwards with an appropriate height, whereby facilitating the cable to insert into the sleeve; after the core wires are soldered on the printed circuit board, the convex hull is pressed downwards.

3. The cable connector component of claim 1, wherein the welding point is disposed on a front end of the upper/lower surface of the sleeve; the sleeve is concave towards the first metal shell to form the welding point; the first metal shell comprises a front end and a rear end; the sleeve covers the rear end and is welded and fixed with the rear end.

4. The cable connector component of claim 2, wherein the terminal pair comprises a first terminal and a second terminal; the first terminal comprises a first contact part, a first connection part, and a first soldering part; the second terminal comprises a second contact part, a second connection part, and a second soldering part; the first connection part and the second connection part comprise a first locking point and a second locking point, respectively, which are disposed oppositely and staggered with each other, and further comprise a first recess and a second recess which are staggered with each other.

5. The cable connector component of claim 4, wherein two first locking points and two second locking points are provided, and the first recess is disposed between the two first locking points, the second recess is disposed between the two second locking points; the first recess is concave in the first terminal away from the second terminal; the second recess is concave in the second terminal away from the first terminal.

6. The cable connector component of claim 5, wherein the first locking point in the vicinity of the first contact part and the second locking point in the vicinity of the second contact part are completely staggered, and a projection of the second locking point in the vicinity of the second contact part is overlapped with a projection of the first recess.

7. The cable connector component of claim 6, wherein the first recess is increasingly narrow from one of the first locking points in the vicinity of the first contact part to the other first locking point; and the second recess is increasingly narrow from one of the second locking points in the vicinity of the second contact part to the other second locking point.

8. The cable connector component of claim 7, wherein the cable comprises a shielding layer coating the core wires, and the shielding layer contacts the fixed iron shell.

9. The cable connector component of claim 1, the connector further comprising a fixed block, and the fixed block covers a soldering zone of the printed circuit board.

10. A board connector component, comprising: a second metal shell comprising a butting chamber, a terminal group and a second insulting body which are fixed in the second metal shell, the second insulting body comprising a base and a clapper disposed at a front end of the base, the clapper comprising a first surface and a second surface which are disposed oppositely, wherein a shielding plate is disposed between the first surface and the second surface, and the shielding plate comprises a protrusion which is extended out of a side of the base and abuts against the second metal shell, and a position of the second metal shell corresponding to the protrusion is punched towards the abutting chamber to form a contact part abutting against the protrusion.

11. The board connector component of claim 10, wherein a soldering part extending downwards is disposed at a rear end of the shielding plate.

12. The board connector component of claim 10, wherein the terminal group comprises a third terminal and a fourth terminal, and the second insulating body comprises a first module fixing the third terminal and a second module fixing the fourth terminal.

13. The board connector component of claim 12, wherein the shielding plate is fixed on the second module in the manner of mounting.

14. The board connector component of claim 10, wherein a rear end of the shielding plate bends downwards to form a reinforcement part corresponding to a high frequency signal terminal.

15. The board connector component of claim 12, wherein the first module is provided with a first ground strip, the second module is provide with a second ground strip, and the first ground strip and the second ground strip are fixed on sides of the first module and the second module, respectively, by laser welding.

16. The board connector component of claims 10, wherein an upper cover is provided on the second metal shell to limit and fix the second metal shell.

17. A composite electric connection, comprising a cable connector component of claim 1 and a board connector component, the board connector component, comprising: a second metal shell comprising a butting chamber, a terminal group and a second insulting body which are fixed in the second metal shell, the second insulting body comprising a base and a clapper disposed at a front end of the base, the clapper comprising a first surface and a second surface which are disposed oppositely, wherein a shielding plate is disposed between the first surface and the second surface, and the shielding plate comprises a protrusion which is extended out of a side of the base and abuts against the second metal shell.

18. A cable connector component, comprising a connector, a fixed iron shell, and a cable comprising a plurality of core wires, wherein the connector comprises at least one pair of terminal pair, a first insulating body, a first metal shell, a group strip, and a printed circuit board; the terminal pair, the ground strip, and the first metal shell are assembled with the first insulating body; the first metal shell is assembled with the fixed iron shell; the fixed iron shell comprises a convex hull which facilitates the cable to insert into the fixed iron shell; the core wires of the cable pass through the fixed iron shell and are connected to one portion of the printed circuit board; a soldering end of the terminal pair is soldered on the other portion of the printed circuit board; and the printed circuit board comprises a wiring communicating with the core wires and the terminal pair.

19. The cable connector component of claim 18, wherein the fixed iron shell comprises a sleeve and a cylinder which is formed by the extension of the sleeve; the convex hull is disposed on an upper and/or a lower surface of the sleeve in the vicinity of the cylinder; the convex hull communicates with the cylinder and protrudes upwards with an appropriate height, whereby facilitating the cable to insert into the sleeve; after the core wires are soldered on the printed circuit board, the convex hull is pressed downwards.

20. The cable connector component of claim 19, wherein the terminal pair comprises a first terminal and a second terminal; the first terminal comprises a first contact part, a first connection part, and a first soldering part; the second terminal comprises a second contact part, a second connection part, and a second soldering part; the first connection part and the second connection part comprise a first locking point and a second locking point, respectively, which are disposed oppositely and staggered with each other, and further comprise a first recess and a second recess which are staggered with each other.

* * * * *